US006029842A

United States Patent [19]

Sheffler et al.

[11] Patent Number: 6,029,842

[45] Date of Patent: Feb. 29, 2000

[54] COSMETIC JAR WITH TRANSPARENT COVER AND HIDDEN THREADS

[75] Inventors: Robert J. Sheffler, Morganville, N.J.; Charles Chang, 55 Westview Rd., Wayne, N.J. 07470

[73] Assignee: Charles Chang, Wayne, N.J.

[21] Appl. No.: 09/116,917

[22] Filed: Jul. 17, 1998

[51] Int. Cl.[7] ..... B65D 41/04

[52] U.S. Cl. ..... 220/288; 220/377; 220/662; 220/62.22

[58] Field of Search ..... 220/288, 377, 220/377.1, 662, 62.11, 62.13, 62.15, 62.22

[56] References Cited

U.S. PATENT DOCUMENTS

| | | | |
|---|---|---|---|
| 1,446,709 | 2/1923 | Leyse | 220/377.1 |
| 1,975,498 | 10/1934 | Billerman | 220/377.1 |
| 2,077,590 | 4/1937 | Seghers | 220/377.1 |
| 2,134,585 | 10/1938 | Seghers | 200/377.1 |
| 2,961,108 | 11/1960 | Johnson | 220/377 X |
| 3,048,301 | 8/1962 | Arpin | 220/377 X |
| 4,747,500 | 5/1988 | Gach et al. | 220/377 X |
| 5,498,333 | 3/1996 | Canther | 220/377 X |

*Primary Examiner*—Stephen K. Cronin
*Attorney, Agent, or Firm*—H. Gibner Lehmann; K. Gibner Lehmann

[57] ABSTRACT

A cosmetic container consisting of a jar having an annular mouth portion and a sealing edge which extends along the mouth portion and is coextensive therewith, and having a screw thread extending along the mouth portion exteriorly of the sealing edge. The jar has a screw cap adapted to be threaded on the screw thread of the mouth portion, and the screw cap has sealing means which are engageable with the sealing edge of the jar for sealing the contents of the latter. The screw cap has a transparent window portion that enables the contents of the jar to be viewed from the exterior. The container is also provided with opaque means that conceals the screw thread and prevents its being viewed from the exterior of the jar.

16 Claims, 2 Drawing Sheets

66
60
62
26
70
64
24
20
22
16
10
68
72
56
60
24
58
54

42
50
34
18
24
20
28
22
16
10
44
36
14
24
48
46
32
26
30
12

17
26
2
35
24
-16-
-10-
2

34
26
35
40
30
18
12
24
28
16
10
20
36
22
24
32
34

COSMETIC JAR WITH TRANSPARENT COVER AND HIDDEN THREADS

CROSS REFERENCES TO RELATED APPLICATIONS

U.S. application Ser. No. 08/677,342 Filed Jul. 2, 1996, entitled COSMETIC JAR in the names of Robert J. Sheffler and Charles Chang and having common ownership with the present application.

STATEMENT AS TO RIGHTS TO INVENTIONS MADE UNDER FEDERALLY-SPONSORED RESEARCH AND DEVELOPMENT

Research and development of the present invention and application have not been Federally-sponsored, and no rights are given under any Federal program.

BACKGROUND OF THE INVENTION

1. Field of the Invention

This invention relates generally to plastic jars for cosmetic substances, and more particularly to jars of this type which have transparent covers or screw caps for the purpose of viewing their contents without opening or breaking the seal thereof.

2. Description of the Related Art Including Information Disclosed Under 37 CFR §§1.97–1.99

In our copending application above identified there are disclosed various jar and seal constructions wherein the jar cap was constituted of a threaded clamping ring which was fitted with a transparent plastic insert panel. Apart from the two-piece characteristic of the cover or cap which was more costly than a one-piece cap, there was the necessity for ensuring a tight seal between the cap and the jar lip. These considerations were factors that governed acceptance and sales, along with other matters such as appearances and the like.

In U. S. Pat. No. 4,747,500 there is disclosed a two-piece screw-type closure having a clamping ring that presses a transparent panel against the opening of a container, to effect a seal therewith. This construction also has the drawbacks listed above, which characterize two-piece closures generally.

Other prior closure devices, while permitting the contents of the container to be viewed, had the drawback of exposing to view the screw threads or other fastening means utilized to secure the seal, and this was considered to detract from the otherwise finished and polished appearance of the container. In the cosmetic field it is recognized that appearances of a luxurious package are an important factor in promoting sales and use of a product, in contrast with mass-marketed products.

The above drawbacks and disadvantages of prior cosmetic containers and packages are obviated by the present invention, and one object of the invention is to provide an improved plastic cosmetic container or jar which has an especially smooth and polished exterior appearance, being devoid of any exposure of structural details that are not related to the mechanics of the actual package.

Another object of the invention is to provide an improved plastic cosmetic container as above set forth, which has the fewest possible number of separate parts.

A further object of the invention is to provide an improved plastic container of the kind indicated, which can be economically fabricated in simple molds, with the fewest number of steps.

Yet another object of the invention is to provide an improved screw-cap type of plastic cosmetic jar or container as above characterized, wherein the opening of the jar is easily and conveniently accomplished by virtue of the relatively large, finger-engageable side wall surfaces on the jar and cap.

A feature of the invention resides in the provision of deep interfitting annular portions of the jar and screw cap, which facilitate the replacement of the cap on the jar.

Another feature of the invention resides in the provision of a jacketed jar which adds strength and durability to the container as a whole, plus versatility in the use of materials, colors, etc.

Still other features and advantages will hereinafter appear.

In accomplishing the above objects the invention provides a unique cosmetic container comprising in combination a plastic jar having an annular mouth portion and a sealing edge thereon which extends along said mouth portion and is coextensive therewith, a screw thread extending along said mouth portion exteriorly of said sealing edge thereon, and a screw cap adapted to be threaded on said screw thread. The screw cap has sealing means that are engageable with the sealing edge of the jar for sealing the contents of the latter, and is constructed of a transparent medium enabling the contents of the jar to be viewed from the exterior thereof. In conjunction with the above, there are unique opaque means for concealing the said screw thread and preventing its being viewed from the exterior of the jar, thereby to enhance the overall appearance of the container.

BRIEF DESCRIPTION OF THE DRAWINGS

In the accompanying drawings, showing several embodiments of the invention.

DESCRIPTION OF A PREFERRED EMBODIMENT

Figure 1:
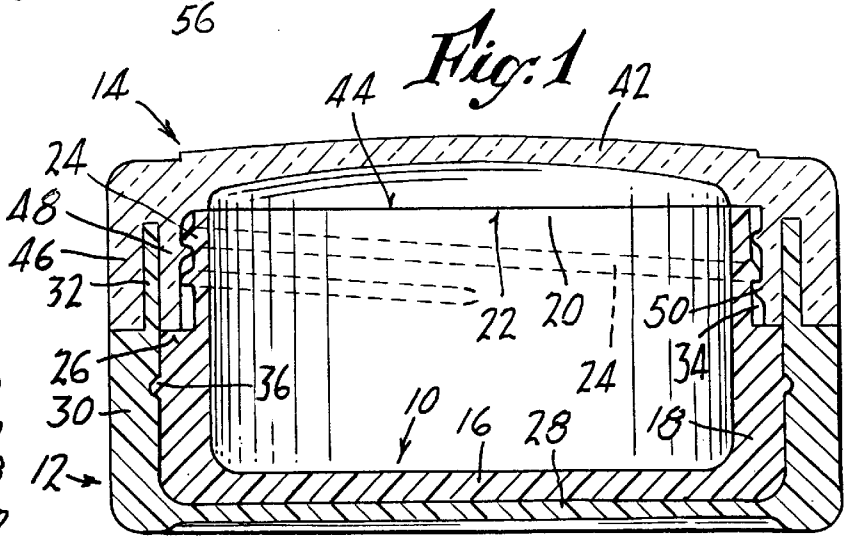
FIG. 1 is a vertical, diametric sectional view of the completed cosmetic container of the invention, comprising a jacketed opaque plastic jar and a transparent plastic screw cap carried by the jar, in an arrangement wherein the screw threads of the jar and cap are concealed and hidden from being viewed from the jar exterior.
Figure 3:
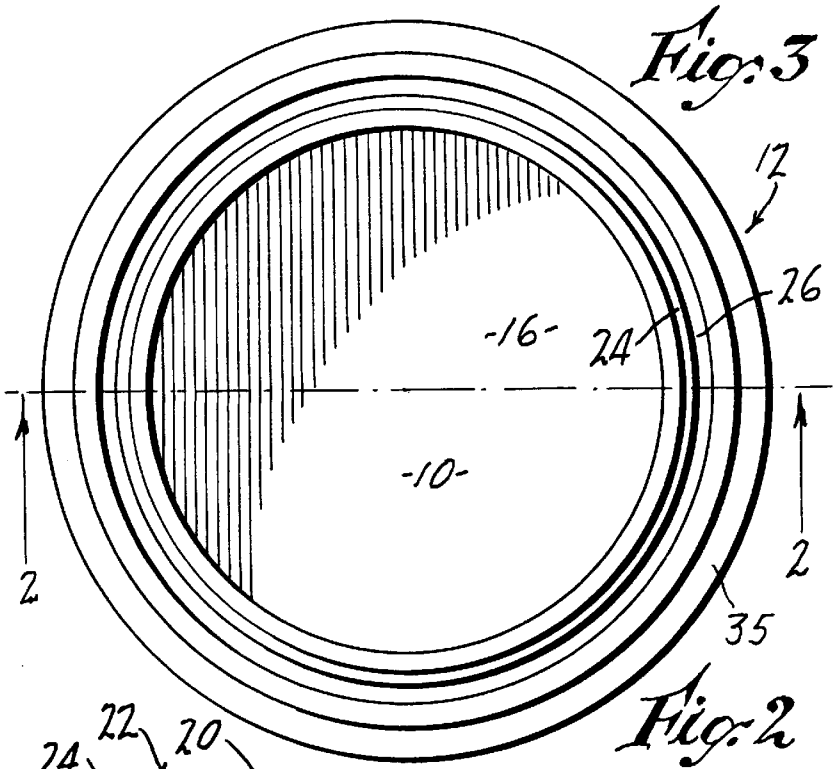
FIG. 3 is a top plan view of the composite jar of FIG. 2.
Figure 2:
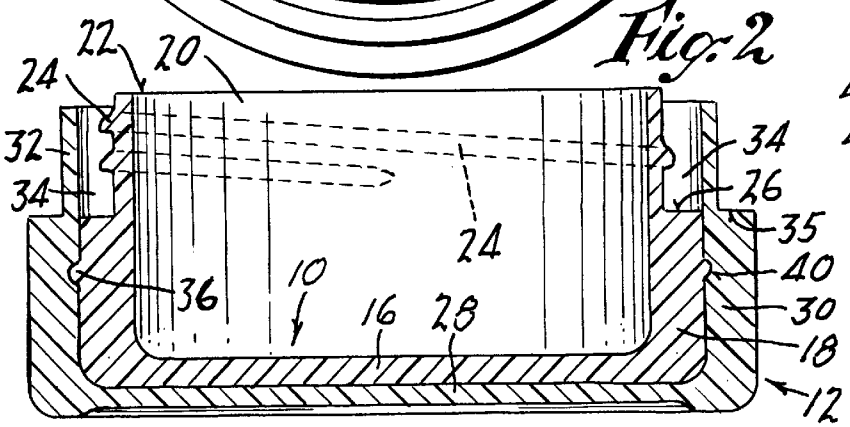
FIG. 2 is an axial sectional view of the jacketed composite jar of the invention per se, as illustrated in FIG. 1.

Referring first to FIGS. 1–3, the present improved container comprises a plastic jar 10 which is enclosed in an opaque plastic jacket 12, such construction accommodating a transparent plastic screw cap 14 which seals the jar and enables the contents thereof to be viewed from the exterior.

The jar 10 has a bottom wall 16 and an annular side wall 18 which latter extends upwardly to an annular mouth portion 20 that has an annular top sealing edge 22. The mouth portion 20 of the jar has an external screw thread 24, and for this purpose the wall thickness of the mouth portion 20 is made thinner as shown, forming an annular external shoulder 26.

The jar 10 is preferably formed of opaque plastic of suitable polymer selected to be compatible with the contained product. The jacket 12 is constituted of opaque plastic, having a bottom wall 28 and an annular side wall 30 which latter has an upward extension 32 that, together with the mouth portion 20 of the jar 10, forms an annular recess 34 in which the screw thread 24 is disposed. The upward extension 32 is thin-walled, resulting in an external shoulder 35 as clearly shown in FIGS. 1 and 2. The jar 10 and jacket 12 are closely fitted to each other, and have interlocking means in the form of an annular exterior bead 36 on the wall 18 of the jar, which is received in an annular groove 40 in the inside of the jacket wall 30 by means of a snap fit.

With the above construction it will be noted that the opaque upward extension 32 of the jacket 12 essentially shields from view the thread 24 on the mouth portion 20 of the jar 10, except if one is looking at the thread 24 from almost directly above. What may not be substantially shielded from view, of the thread 24, will be shielded when the screw cap 14 is in place on the jar 10 even though the cap 14 is constituted of transparent plastic, this being a function of the angle of viewing and the thickness and surface angles of the cap.

The cap 14 comprises a somewhat convex central transparent window portion 42, an annular sealing surface or means 44 which is engageable with the sealing edge or land seal 22 of the jar 10, an annular outer skirt portion 46 and an annular inner skirt portion 48. Between the skirt portions 46 and 48 there exists an annular recess which is adapted to receive the upward extension 32 of the jacket 12 when the cap 14 is screwed on the jar. The inner skirt portion 48 of the screw cap 14 is received in the recess 34 of the jar 10 and has a screw thread 50 which is cooperable with the screw thread 24 of the jar.

For purposes of clarity of illustration, certain open spacing and clearances between the various components have not been shown; however, it will be understood by those skilled in the art that dimensions can be adjusted to provide the proper sealing force between the sealing edge 22 of the jar 10 and the cooperating surface 44 of the screw cap, while at the same time providing a smooth exterior finish between the jacket 12 and the cap 14 where the shoulder 35 of the jacket meets the bottom edge of the outer skirt portion 46 of the cap. Other clearances can be chosen to suit the requirements of good plastic molding practice, as will be clear.

Considering FIG. 1 it will be seen that the opacity of the upward extension 32 of the jacket 12 will laterally hide most all of the thread 24, and that the inner skirt portion 48 of the cap 14 can effectively block the view of the thread from higher locations.

Figure 4:
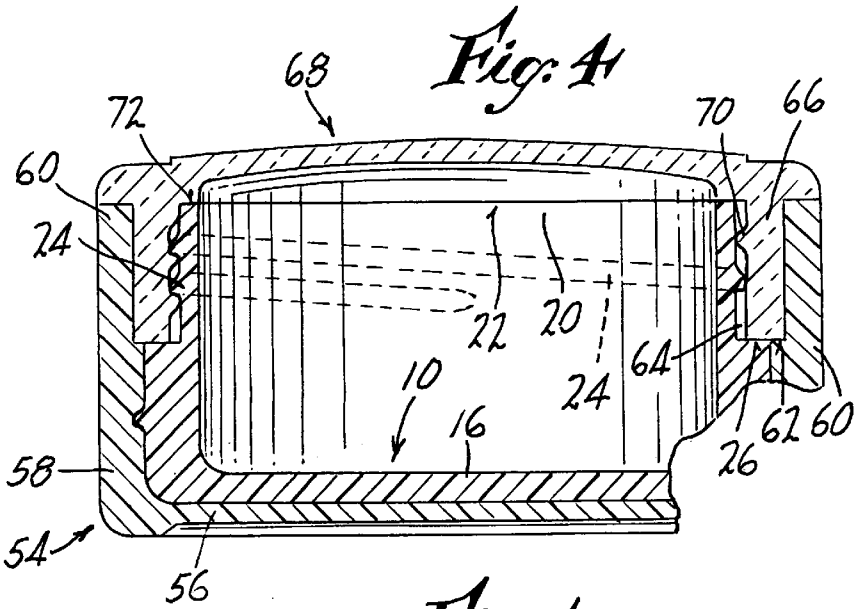
FIG. 4 is a fragmentary axial sectional view similar to that of FIG. 1 but showing another embodiment of the invention, wherein certain simplifications of the structures have been achieved.

Another embodiment of the invention is shown in FIG. 4, wherein the configurations of the jacket for the jar, and the screw cap, are somewhat simplified. The jar in FIG. 4 is essentially similar to the jar 10 of FIGS. 1–3 and accordingly the same reference characters are used to designate and describe the jar per se in FIG. 4.

In FIG. 4 the jacket is given the reference character 54; it has a bottom wall 56 and an annular side wall 58, including an upward extension 60 of the side wall, as shown. The extension 60 is of lesser thickness, making for an inner annular shoulder 62 which can be flush with the shoulder 26 of the jar 10.

Between the mouth portion 20 of the jar 10 and the extension 60 of the jacket there is an annular space 64 which can now be occupied by a depending skirt portion 66 of the screw cap 68. The skirt portion 66 of the cap 68 has a screw thread 70 which engages the thread 24 of the jar 10. An annular sealing surface 72 of the cap 68 engages the top sealing edge 22 of the jar 10 to effect the seal of the same.

In the embodiment of FIG. 4 the external joint or horizontal interface between the screw cap 68 and the jacket 54 is near the top of the container, about on the same level as the level of the sealing edge 22 of the jar 10. In the embodiment of FIGS. 1–3 the external joint or horizontal interface between the screw cap 14 is approximately midway between the top and bottom of the container. Depending on the molding characteristics of the materials and the construction of the molds, either one or the other might prove to be advantageous in ensuring a smooth joint with flush surfaces.

The embodiment of FIGS. 1–3 has the advantage of increased gripping surfaces on the screw cap at the side walls thereof, making for an easy and convenient opening of the jar.

Figure 5:
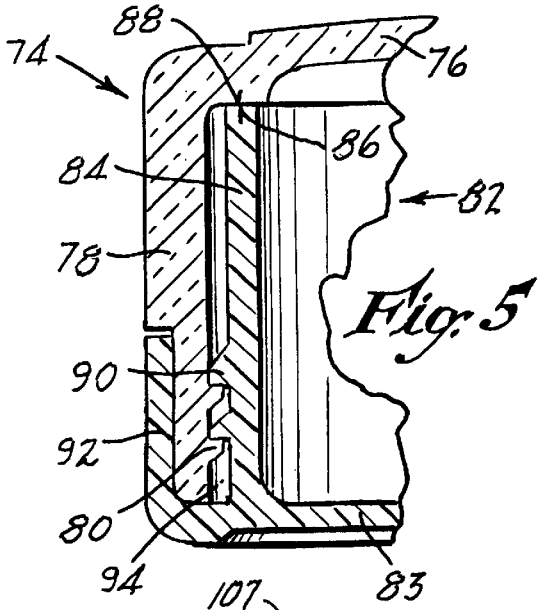
FIG. 5 is a fragmentary axial sectional view of a jacketed jar illustrating another embodiment of the invention, wherein a depending skirt of the screw cap fits within an annular recess formed by the jar at the lower portion thereof.

Another embodiment of the invention is illustrated in FIG. 5, wherein a depending skirt portion of the screw cap fits into an annular concealment recess formed in the opaque jar at the lower portion thereof, to normally provide concealment of the screw threads. As shown, the screw cap 74, which has a transparent window portion 76, is provided with an expansive, downwardly-extended skirt 78 that has internal screw threads 80. The jar 82, which is opaque, has a bottom wall 83 and at the peripheral portion thereof an upstanding annular side wall 84 the top edge 86 of which sealingly engages an annular undersurface 88 of the cap. This seals the contents of the jar 82.

At its lower portion the jar wall 84 has external screw threads 90 which engage the threads 80 to draw the screw cap 74 tightly onto the jar 82. The jar has an annular upstanding concealment flange 92 which, together with the wall 84, forms the annular recess 94 in which the skirt 78 fits and into which it is threaded. With this construction, the concealment flange 92 normally effectively hides the threads 80, 90 from view.

Figure 6:
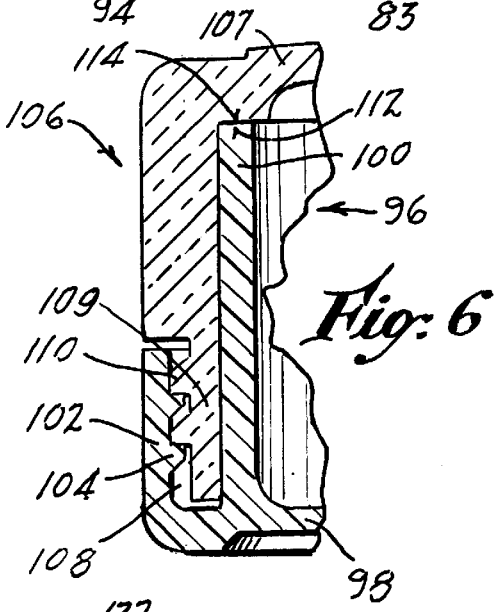
FIG. 6 is a fragmentary axial sectional view like that of FIG. 5, but showing still another embodiment of the invention.

Still another embodiment of the invention is shown in FIG. 6, wherein the screw-thread securement involves the concealment flange of the opaque jar. In this figure the jar 96 with bottom wall 98 has an upstanding annular side wall 100 and a lower concealment flange which latter has internal screw threads. The wall 100 is devoid of threads. The screw cap 106 has a transparent top face 107 and a depending skirt 109 that fits into the recess 108, and has external screw threads 110 on the skirt, which mate with the threads 104 of the flange 102 to draw the cap down tightly. Sealing is effected by the top edge 112 which is engaged with the annular sealing undersurface 114 of the cap.

Figure 7:
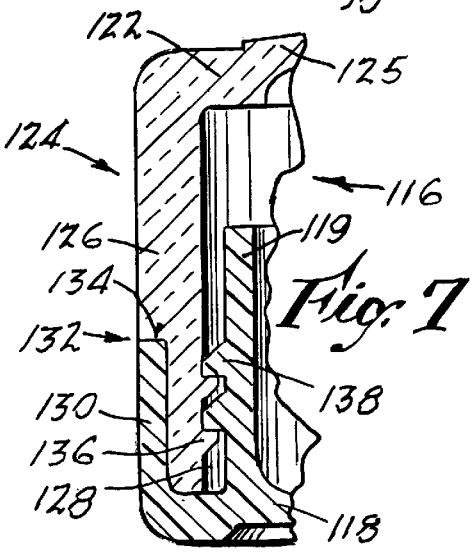
FIG. 7 is a fragmentary axial sectional view like those of FIGS. 5 and 6 but illustrating yet another embodiment of the invention.

An additional embodiment of the invention is illustrated in FIG. 7. Here the jar 116 has a bottom wall 118 and an annular side wall 119 which stops short of the top wall 122 of the screw cap 124. In this embodiment the top edge of the inside annular wall 119 is disposed substantially in a plane which is located at a point that is approximately one-half the distance between the top edge of the flange 130 of the jar 116 and the underside of the screw cap 124. In this respect it differs from the embodiment of FIG. 5.

The screw cap 124 has a transparent top face 125 and a depending annular skirt 126 which latter fits into an annular recess 128 between the jar wall 120 and an upstanding flange 130 of the jar 116.

In FIG. 7 the seal of the jar 116 is effected by a tight joint or interface 132 between the flange 130 and a shoulder surface 134 of the skirt 126 of the cap 124. The skirt 126 has internal threads 136 which engage external threads 138 on the jar wall 119.

Figure 8:
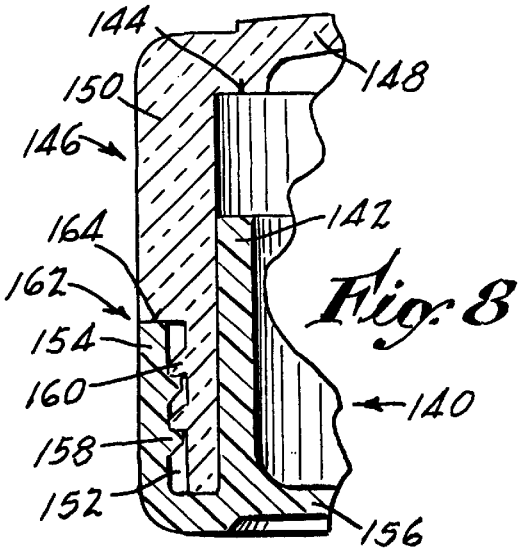
FIG. 8 is a fragmentary axial sectional view like those of FIGS. 5–7 but illustrating still another embodiment of the invention.

A further embodiment of the invention is shown in FIG. 8 wherein the jar 140 has an annular side wall 142 that is also short of the top wall 144 of the screw cap 146. In this embodiment as in the embodiment of FIG. 7, the top edge of the inside annular wall 142 is disposed substantially in a plane which is located at a point that is approximately one-half the distance between the top edge of the flange 154 of the jar 140 and the underside of the screw cap 146. The cap 146 is transparent or has a transparent top window portion 148, and a depending skirt 150 which fits into an annular recess 152 of the jar, located between the jar wall 142 and an upstanding flange 154 of the jar. The flange 154 and the wall 142 encircle the bottom wall 156 of the jar. Cooperable threads 158 and 160 are disposed respectively on the flange 154 and the skirt 150. Sealing of the jar is effected by a joint or interface 162 between the top of the flange 154 and a shoulder 164 on the skirt 150.

Figure 9:
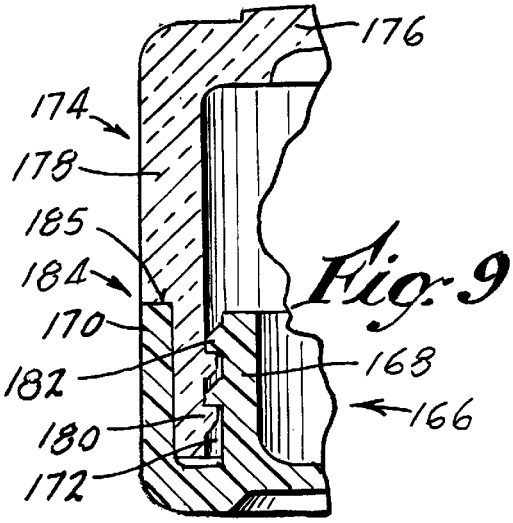
FIG. 9 is a fragmentary sectional view like those of FIGS. 5–8 but showing yet another embodiment of the invention.

FIG. 9 illustrates yet another embodiment of the invention, wherein the annular side wall of the jar 166 has a still lesser depth as compared with the preceding embodiments. As shown in this figure, the top edge of the inside annular wall 168 of the jar 166 is located substantially in a plane that is below the top edge of the flange 170 of the jar 166. The jar bottom carries the side wall 168 and also an annular upstanding flange 170, these forming between them an annular recess 172. The screw cap 174 has a top transparent portion 176 and a depending skirt which is disposed in the recess 172. Cooperable screw threads 180 and 182 on the skirt 178 and jar wall 168 respectively provide the fastening for the screw cap 174.

The seal for the jar 166 is effected by the interface or joint 184, where the skirt 178 provides a shoulder 185.

Figure 10:
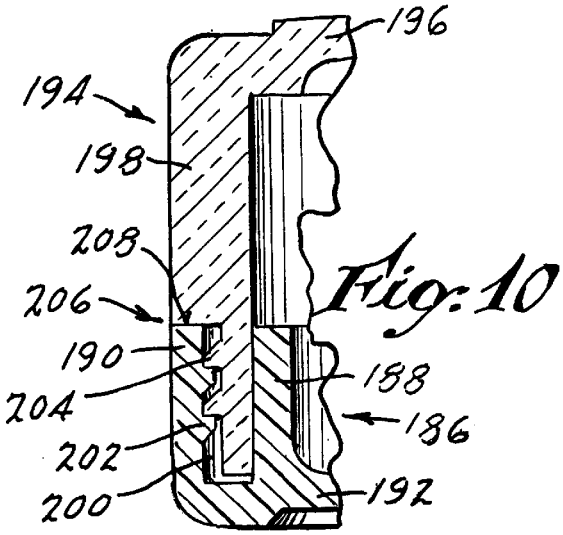
FIG. 10 is a fragmentary axial sectional view like those of FIGS. 5–7 but illustrating a further embodiment of the invention.

In FIG. 10 another embodiment of the invention is shown, wherein a jar 186 with a low annular side wall 188 has an upstanding flange 190, both of these being carried by the jar bottom wall 192. The top edge of the annular inside wall 188 of the jar 186 is located substantially in a plane that contains the top edge of the flange 190 of the jar 186. The screw cap 194 has a transparent window portion 196 and a depending skirt 198, the latter fitting into an annular recess 200 between the flange 190 and the wall 188. Screw threads 202 and 204 on the flange and skirt respectively provide for the tightening of the screw cap 194. The jar 186 is sealed at the interface or joint 206 between the top of the flange 190 and a shoulder 208 on the skirt 198 respectively.

The embodiments of FIGS. 5–10 are characterized by the skirt of the screw cap fitting into an annular recess formed between a flange and a side wall of the opaque jar, whereby the flange conceals the screw threads that are used to secure the cap in place. Each of these embodiments is useful in a particular environment and with particular cosmetics, depending on the circumstances involved. The embodiments enable the wall thickness of the cover to be reduced, and in some cases the cover can be molded by a cam mold for the threads, which is faster than the conventional unscrewing type of mold. Also, by having inner walls of different heights, it is possible to change the capacity to hold product without changing the overall size of the container, while still using the same cap.

Each and every one of the appended claims defines an aspect of the invention which is complete in and of itself, separate and distinct from all the others, and accordingly it is intended that each claim be treated in this manner when examined in the light of the prior art devices in any determination of novelty or validity.

Variations and modifications are possible without departing from the spirit of the invention, and portions of the improvement can be used without others.

What is claimed is:

1. A cosmetic container comprising in combination:

a) a jar having an annular sealing edge and a wall provided with a screw thread, b) a screw cap having a screw thread, said cap being adapted to be threaded on said screw thread of the jar, c) said screw cap having sealing means engageable with the sealing edge of the jar for sealing the contents of the latter, and having a transparent window portion enabling the contents of the jar to be viewed from the exterior thereof, and d) opaque means on said jar for concealing both of the said screw threads and preventing their being viewed from the exterior of the container, said opaque means comprising an annular unbroken exterior portion of said jar which is visible from the jar exterior and is separate and distinct from the said jar wall that has the screw thread.

2. A cosmetic container comprising in combination:

a) a jar having an annular sealing edge and a screw thread, b) a screw cap having a screw thread, said cap being adapted to be threaded on said screw thread of the jar, c) said screw cap having sealing means engageable with the sealing edge of the jar for sealing the contents of the latter, and having a transparent window portion enabling the contents of the jar to be viewed from the exterior thereof, and d) opaque means on said jar for concealing both of the said screw threads and preventing their being viewed from the exterior of the container, e) said opaque means comprising an opaque jacket on said jar, f) said jar having an annular side wall, g) said jacket having an annular side wall surrounding the side wall of the jar, i) said side wall of the jacket surrounding the screw thread of the jar and shielding the thread from view from the exterior of the container.

3. A cosmetic container as claimed in claim 2, wherein:

a) the screw cap has an annular portion disposed above and meeting the annular side wall of the jacket, said annular side wall and annular jacket portion forming a smooth, exterior joint therewith.

4. A cosmetic container as claimed in claim 2, wherein the side wall of the jacket has a top edge which is at substantially the same level as the top edge of the annular side wall of the jar.

5. A cosmetic container as claimed in claim 2, wherein the screw cap has a skirt portion disposed above the annular side wall of the jacket, said skirt portion meeting the annular side wall of the jacket and making a smooth, exterior joint therewith at a point substantially midway of the height of the container.

6. A cosmetic container as claimed in claim 2, wherein:

a) the annular side wall of the jar and the said side wall of the jacket form an annular recess, b) said screw cap having a depending skirt adapted to be received in said annular recess.

7. A cosmetic container as claimed in claim 6, wherein the said screw thread of the jar is disposed in the said annular recess.

8. A cosmetic container as claimed in claim 2, wherein the said jacket comprises a cup in which the jar is received with a close fit.

9. A cosmetic container as claimed in claim 8, wherein the jar and jacket have an interlocking fit between the annular side walls thereof.

10. A cosmetic container comprising in combination:

a) a jar having an annular sealing edge and a screw thread, b) a screw cap having a screw thread, said cap being adapted to be threaded on said screw thread of the jar, c) said screw cap having sealing means engageable with the sealing edge of the jar for sealing the contents of the latter, and having a transparent window portion enabling the contents of the jar to be viewed from the exterior thereof, and d) opaque means on said jar for concealing both of the said screw threads and preventing their being viewed from the exterior of the container, e) said jar having an inside annular wall and an outer flange, forming an annular recess, f) said screw cap having a skirt disposed in the recess, g) said threads being disposed in the said recess.

11. A cosmetic container as claimed in claim 10, wherein:

a) the inside annular wall of the jar has the thread thereof, said thread being external on the wall, b) said skirt of the screw cap having the thread thereof, said thread being internal, c) all portions of said threads being disposed in the said recess.

12. A cosmetic container as claimed in claim 11, wherein the top edge of the inside annular wall of the jar is disposed substantially in a plane which is located at a point that is approximately one-half the distance between the top edge of the flange of the jar and the underside of the screw cap.

13. A cosmetic container as claimed in claim 11, wherein the top edge of the inside annular wall of the jar is located substantially in a plane that is below the top edge of the outer flange of the jar.

14. A cosmetic container as claimed in claim 10, wherein, a) the thread of the screw cap is on the skirt thereof and is an outer thread, and b) the thread of the jar is an inner thread mating with said outer thread.

15. A cosmetic container as claimed in claim 14, wherein the top edge of the inside annular wall of the jar is disposed substantially in a plane which is located at a point that is approximately one-half the distance between the top edge of the outer flange of the jar and the underside of the screw cap.

16. A cosmetic container as claimed in claim 14, wherein the top edge of the inside annular wall of the jar is located substantially in a plane that contains the top edge of the outer flange of the jar.

* * * * *